US006229497B1

(12) United States Patent
McCracken

(10) Patent No.: US 6,229,497 B1
(45) Date of Patent: May 8, 2001

(54) ANTENNA MOUNTS

(76) Inventor: Ronald G. McCracken, 8924 West La., Magnolia, TX (US) 77355

( * ) Notice: Subject to any disclaimer, the term of this patent is extended or adjusted under 35 U.S.C. 154(b) by 0 days.

(21) Appl. No.: 09/388,522

(22) Filed: Sep. 2, 1999

(51) Int. Cl.[7] ..... H01Q 1/12

(52) U.S. Cl. ..... 343/878; 343/879; 343/890; 343/880; 248/346.01; 248/188.5; 248/188.8

(58) Field of Search ..... 343/878, 879, 343/880, 881, 890, 891, 883, 901; 248/516, 526, 237, 180.1, 404, 346.01, 533, 188.5, 188.8, 188.9; 52/651.07

(56) References Cited

U.S. PATENT DOCUMENTS

| | | | | |
|---|---|---|---|---|
| D. 254,305 | | 2/1980 | Colish | D14/91 |
| D. 312,257 | | 11/1990 | Fahy | D14/238 |
| D. 359,272 | | 6/1995 | Fahy | D14/238 |
| D. 362,854 | | 10/1995 | Fahy | D14/238 |
| 4,101,036 | | 7/1978 | Craig | 211/86 |
| 4,521,036 | | 6/1985 | Howell, Jr. et al. | 285/61 |
| 4,649,675 | * | 3/1987 | Moldovan et al. | 52/27 |
| 4,799,642 | * | 1/1989 | Wright | 248/516 |
| 4,852,692 | | 8/1989 | Flaherty | 182/231 |
| 4,942,943 | | 7/1990 | Flaherty | 182/231 |
| 4,998,114 | * | 3/1991 | Eto et al. | 343/840 |
| 5,435,509 | | 7/1995 | Bingham | 248/159 |
| 5,576,722 | * | 11/1996 | Bustillos | 343/882 |
| 5,816,554 | | 10/1998 | McCracken | 248/346.01 |

* cited by examiner

*Primary Examiner*—Tan Ho
*Assistant Examiner*—Ephrem Alemu
(74) *Attorney, Agent, or Firm*—Shawn Hunter Bracewell & Patterson, LLP

(57) ABSTRACT

Devices and methods are described by which antennas can be securely mounted upon rooftops and similar supporting surfaces. Antenna mounts are described that distribute the load associated with the antenna substantially evenly upon the rooftop or other support surface, so that potential damage to the roof structure is reduced or eliminated. In preferred embodiments, the antenna mounts are provided with support legs and load-distributing base members that are substantially devoid of sharp corners or angles. The antenna mounts also provide a platform located above and proximate the base members for the placement of weights to ensure the stability of the antenna mounts. This ensures that the weights are disposed above the roof and are not in contact with it. Connectors and/or adhesives are not required to secure the mount to a rooftop as the weighting is sufficient to provide a stable and wind resistant mount. Thus, the mount can be placed into use on a rooftop and remain a "dead load" which is unattached to the building. Additionally, the antenna mounts are preferably collapsible so that they can be stored or transported as a compact unit.

16 Claims, 5 Drawing Sheets

ANTENNA MOUNTS

BACKGROUND OF THE INVENTION

1. Field of the Invention

The present invention relates to devices for the stable mounting and securing of antennas and the like. The invention has particular utility for the mounting and securing of an antenna upon the roof of a building 2. Description of the Related Art As cellular phones, facsimile machines and other wireless technology have proliferated, greater numbers and amounts of telecommunications support equipment has become necessary. In many instances, antennas and other support equipment are mounted on the roofs of buildings. In part, this is done to take advantage of the height of the existing building in providing a signal that can pass over obstructions.

Antennas for such systems require stable mounts that provide a substantially vertically-disposed shaft or pole to which the antenna can be clamped. Unfortunately, currently known antenna mounts have significant disadvantages. Many systems are stabilized by affixation to the roof or other parts of the building structure. Usually, such affixation is accomplished by using screws, anchors or other connectors that are secured within the roofing structure, thereby damaging the roofing material and contributing to leakage into the building. Further, many conventional antenna mounting structures have sharp edges and corners that can cut or gouge the roofing material, again damaging the roof material, particularly over the long term. Examples of such systems are found in U.S. Pat. Nos. D312,257 and D359,272. Because the support members of these systems are adapted to be affixed to the rooftop, thereby transmitting their loading into structural members in the roof, they do not incorporate mechanisms that effectively distribute weight forces across the surface of the roof.

U.S. Pat. No. 4,799,642 describes an antenna mounting wherein few, if any, connectors are required to secure the structure to a rooftop. Unfortunately, this mounting also provides sharp corners on its feet that can potentially damage the rooftop. The feet are secured to the rooftop using adhesive, which may break down over time allowing the mounting to become unstable. Each of the four legs of this mounting can be weighted by placing weight, such as concrete or the like, inside of the feet of the leg assembly. However, the volume available for disposing weights within the foot is limited. Thus, the amount of weight that can be added in this fashion is also limited. In addition, it is suggested that the feet be filled with concrete or the like after placement of the feet upon the roof. This poses practical logistical problems in pouring the liquid concrete mix on a rooftop. In addition, the mounting has a number of individual components that must be brought onto the rooftop, sometimes separately, and then assembled in a time consuming process.

A further disadvantage of the mounting structure stems from the fact that the upper surface of the foot is used for the attachment of struts and the like. Therefore, placing any additional weights atop the foot risks damaging these attachments. Further, if such additional weights were placed atop the foot, the weight forces they would contribute would be concentrated at the point where the weight is placed since the foot lies in contact with the roof surface and lacks any structure for distributing the weight forces.

A related problem with all such mounting systems that are affixed to rooftops using connectors or adhesives is that, when the mount becomes affixed to the building, it becomes a "live load" and, therefore must meet different, often more restrictive requirements, for total load and load distribution.

It would be an improvement to have devices that address the problems of the prior art.

SUMMARY OF THE INVENTION

The present invention provides devices and methods by which antennas can be securely mounted upon rooftops and similar supporting surfaces. Embodiments are described that permit mounting of single or multiple antennas upon a single support. The antenna mounts distribute the load associated with the antenna substantially evenly upon the rooftop or other support surface, so that potential damage to the roof structure is reduced or eliminated. In preferred embodiments described herein, the antenna mounts are provided with support legs and load-distributing base members that are substantially devoid of sharp corners or angles.

The antenna mounts also provide a platform located above and proximate the base members for the placement of weights to ensure the stability of the antenna mounts. This ensures that the weights are disposed above the roof and are not in contact with it.

Connectors and/or adhesives are not required to secure the mount to a rooftop as the weighting is sufficient to provide a stable and wind resistant mount. Thus, the mount can be placed into use on a rooftop and remain a "dead load" which is unattached to the building.

Additionally, the antenna mounts are preferably collapsible so that they can be stored or transported as a compact unit.

DETAILED DESCRIPTION OF THE PREFERRED EMBODIMENTS

Figure 1:
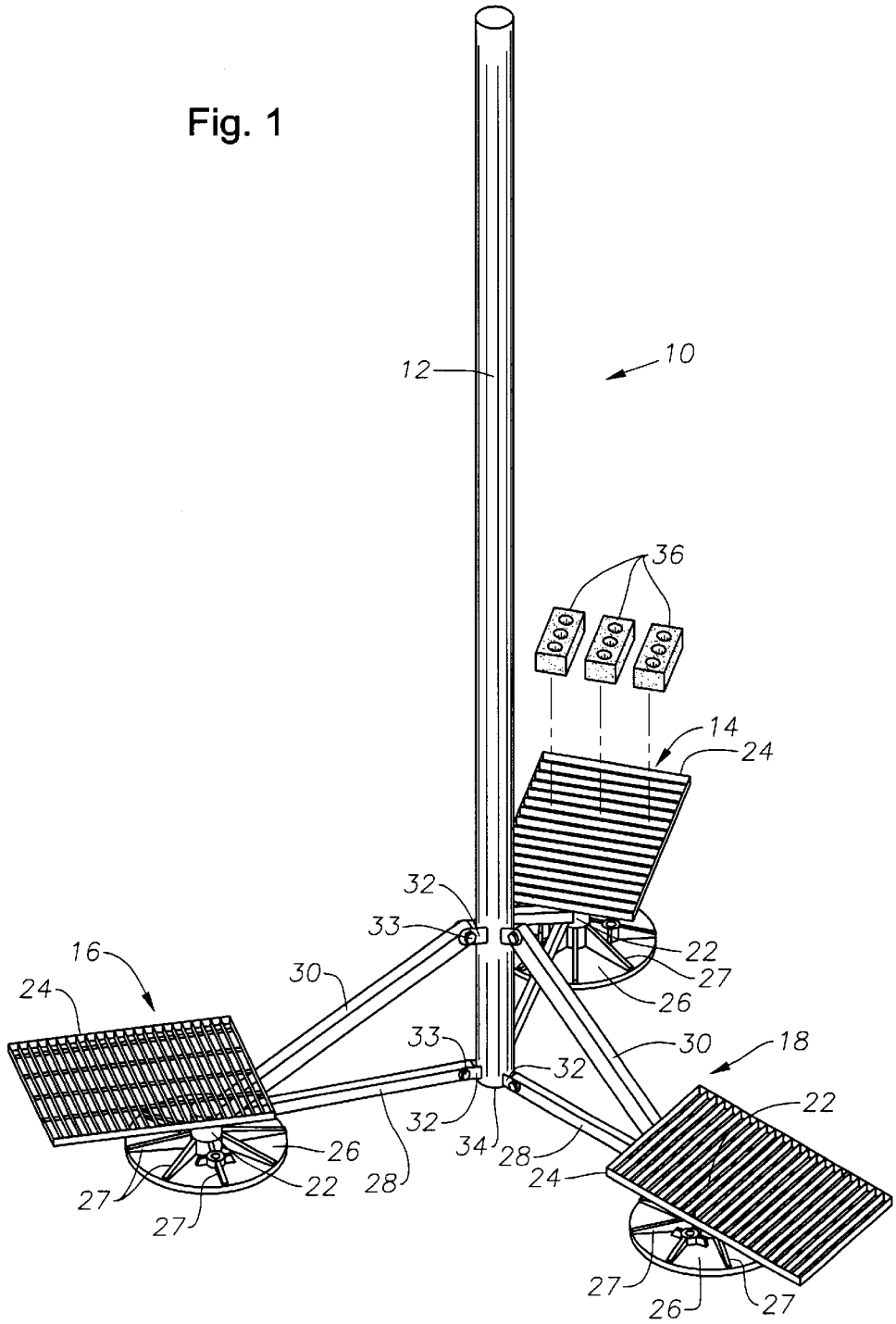
FIG. 1 is an isometric view of an exemplary three-legged antenna mount constructed in accordance with the present invention.
Figure 3:
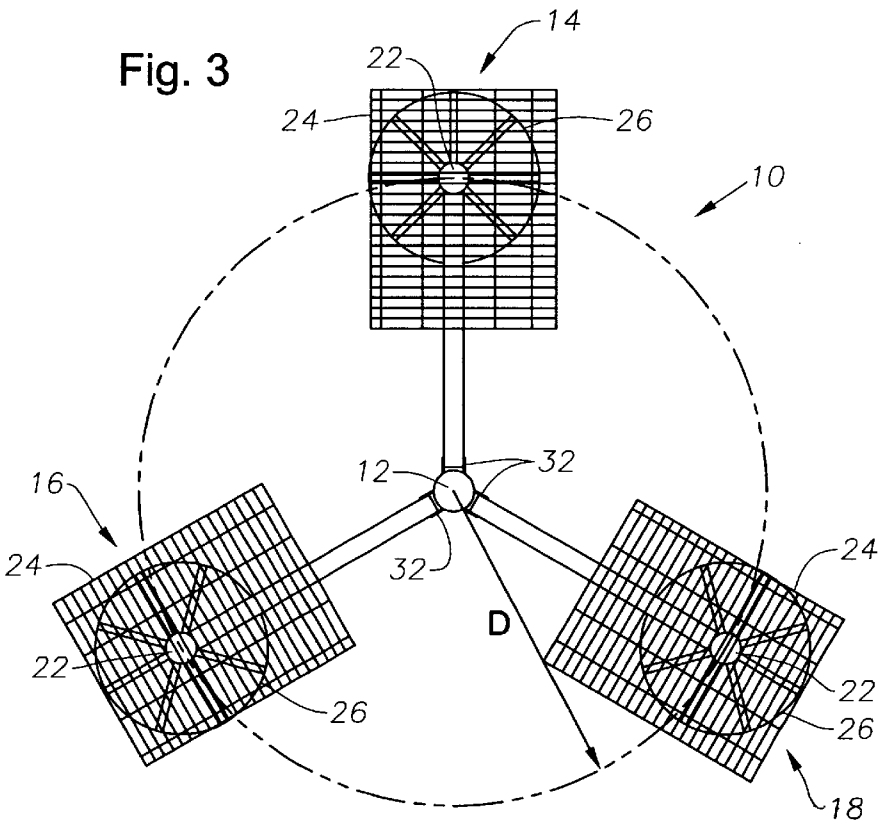
FIG. 3 is a plan view of the antenna mount shown in FIGS. 1 and 2.
Figure 2:
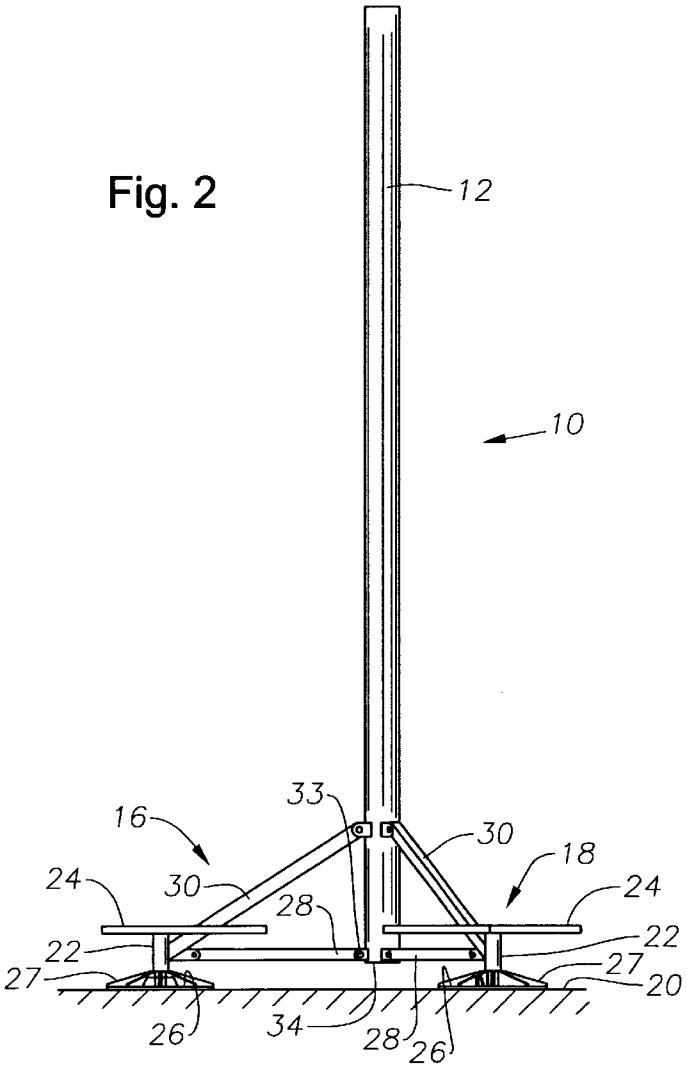
FIG. 2 is a side view of the antenna mount depicted in FIG. 1.
Figure 4:
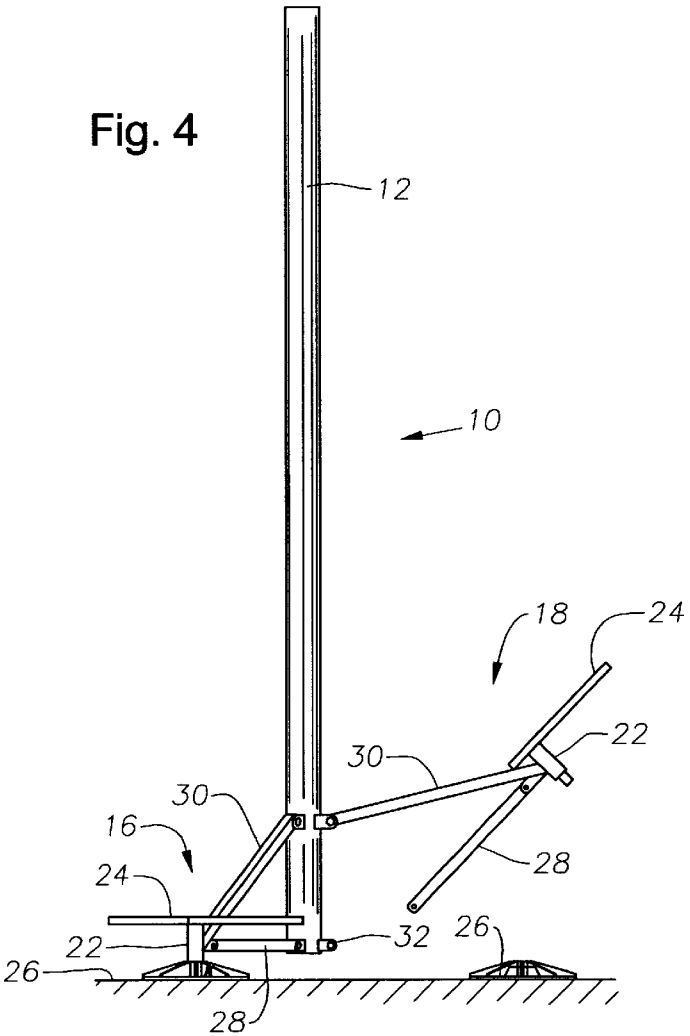
FIG. 4 illustrates the antenna mount of FIGS. 1–3 in a partially collapsed position.
Figure 6:
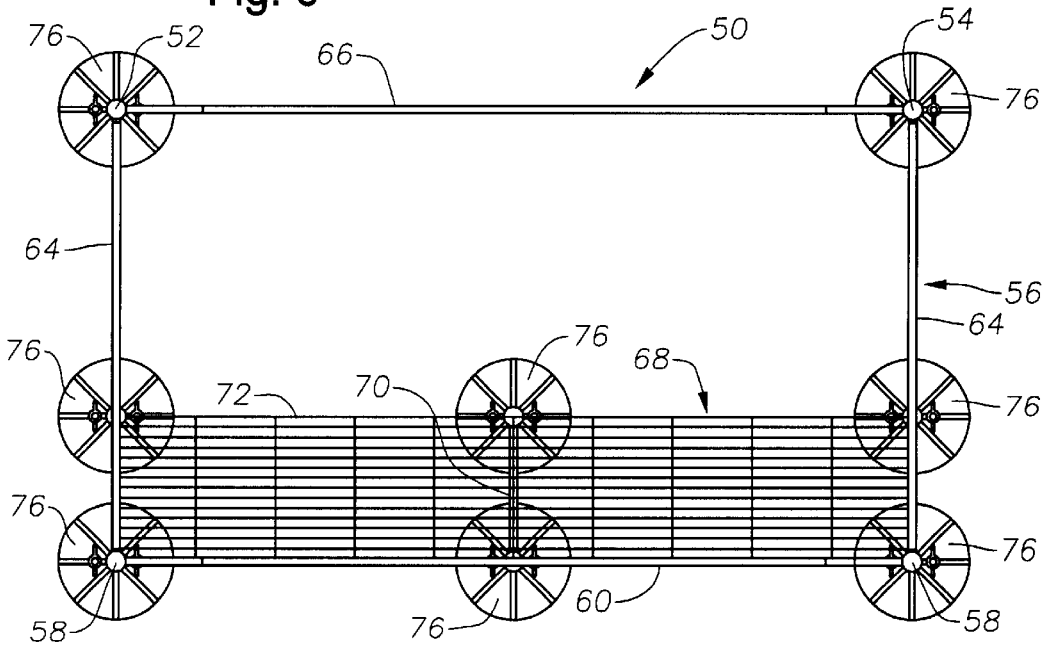
FIG. 6 is a plan view of an exemplary four-legged antenna mount constructed in accordance with the present invention.
Figure 7:
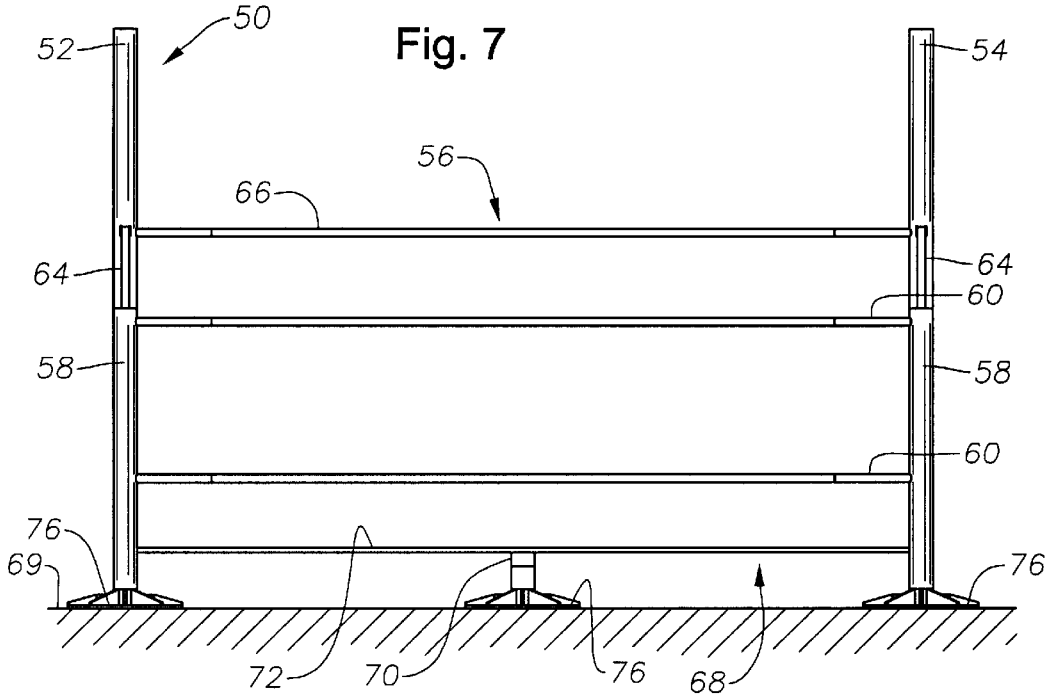
FIG. 7 is a front view of the antenna mount shown in FIG. 6.
Figure 8:
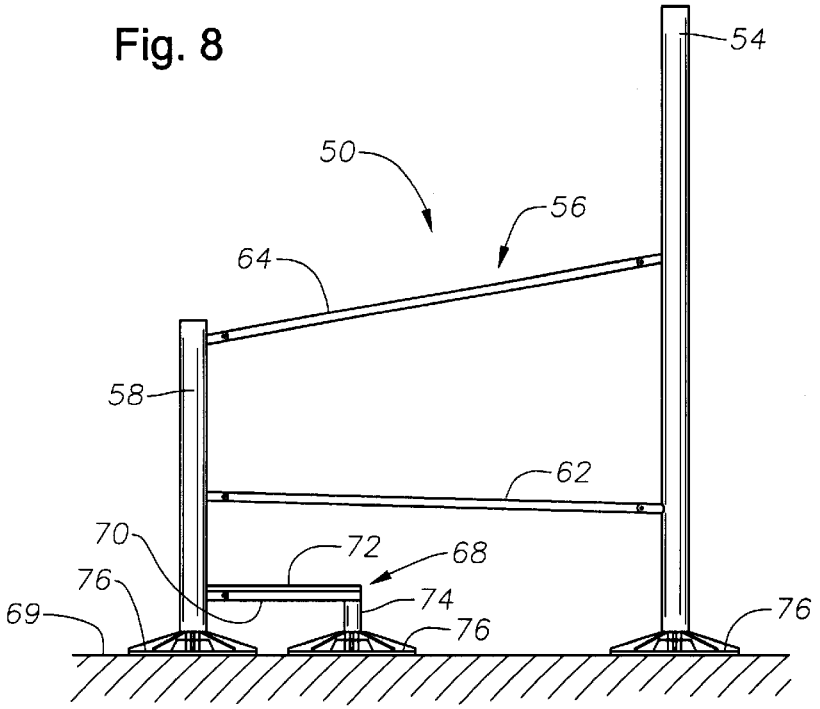
FIG. 8 is an end view of the antenna mount depicted in FIGS. 6 and 7.
Figure 9:
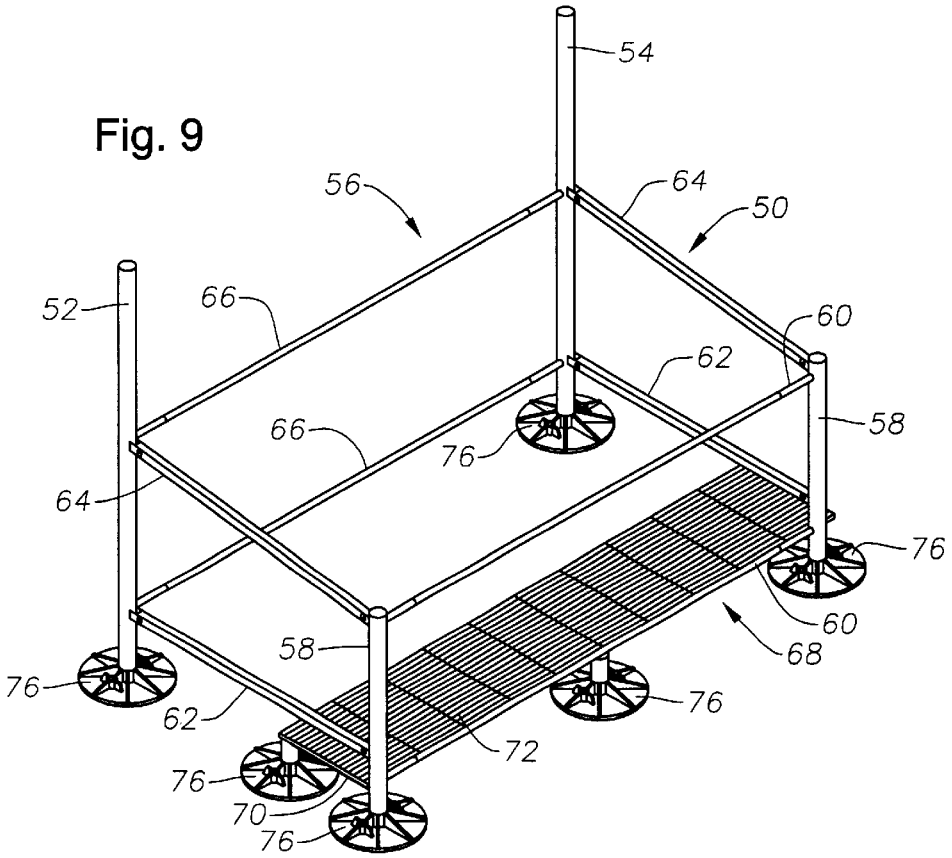
FIG. 9 is an isometric view of the antenna mount shown in FIGS. 6–8.

FIGS. 1–5, illustrate an exemplary three-legged antenna mount 10 that is constructed in accordance with the present invention. FIGS. 1–3 depict the antenna mount 10 in an assembled condition. FIG. 4 shows the antenna mount 10 partially collapsed while FIG. depicts the antenna mount 10 in a fully collapsed position that might be used for storage or transportation of the mount 10.

The antenna mount 10 includes a central, vertically-oriented shaft 12, which is preferably hollow, to which an antenna (not shown) can be affixed by clamping, or other well-known means. The antenna is typically a telecommunications-type antenna, however, the invention is equally applicable to radio antennae and other varieties of antennas or devices. Because the affixation of antennas to vertically-oriented shafts and poles is well understood, it will not be described here. Additionally, the wiring and components associated with antennas will not be described here, such also being well known.

Three leg assemblies 14, 16 and 18 extend radially outwardly from the shaft 12 and contact a horizontal support surface 20 (shown in FIG. 2). The leg assemblies 14, 16 and 18 each include a vertically-oriented leg 22 that supports a horizontal platform 24 at its upper end. As FIG. 3 illustrates, each of the legs 22 is located at approximately the same distance D from the shaft 12 when the mount 10 is in its assembled condition. The platforms 24 are formed of sturdy and durable grates that are preferably formed of metal such as iron or steel, although other suitable material may be used. The grates are grids that define a plurality of apertures through which airflow and drainage is permitted.

The lower end of each leg 22 is disposed within a load distributing base 26 that has a substantially circular footprint. The bases 26 are preferably of the type described in further detail in U.S. Pat. No. 5,816,554 entitled "Equipment Support Base" by Ronald G. McCracken, which is herein incorporated by reference. The bases 26 are lightweight and effectively distribute weight over the entire footprint of the base 26 so as to avoid unnecessarily localized stresses in the support surface 20. In addition, the bases 26 are devoid of any sharp corners or angles that would tend to cut into and damage roofing material over time, particularly as the roofing material expands and contracts with temperature. The bases 26 include a number of radially extending ribs 27 that receive the weight forces from the center of the base 26 and distribute it across the support surface 20.

It is pointed out that neither the bases 26 nor other portions of the antenna mount 10 need to be secured to the support surface or to the structure of a building, thereby making installation of the mount 10 inexpensive and quick. Further, the structure of the rooftop 20 is not damaged by the use of fasteners.

Although not shown, it is preferred that in rooftop applications, a slip sheet formed of roofing material or another suitable, durable material be placed between the bases 26 and the roof surface 20. The slip sheet will tend to hold the base in place and resist movement of the base with respect to the roof surface 20.

Each of the leg assemblies 14, 16 and 18 also include a pair of struts 28, 30 that extend between the leg 22 and the shaft 12. The struts 28, 30 are affixed to the leg 22 and shaft 12 by brackets 32, best shown in FIG. 1. Connectors used to affix the struts 28, 30 to the leg 22 and shaft 12 are preferably nut-and-bolt assemblies 33 or other arrangements that permit reversible connection.

The lower strut 28 extends essentially horizontally between the leg 22 and shaft 12, being affixed proximate the lower end 34 of the shaft 12. Upper strut 30 angles upwardly as it extends from the leg 22 toward the shaft 12 so that it is affixed to the shaft 12 at a higher point on the shaft 12 than strut 28 is. It is pointed out that the struts 28, 30 secure the shaft 12 securely in a substantially vertical orientation with respect to the support surface 20.

The platforms 24 serve the purpose of permitting weights, such as bricks 36 in FIG. 1, to be placed upon each of the leg assemblies 14, 16, 18, thereby making the mount 10 more stable and resistant to wind loading that might tend to topple the mount 10. Currently preferred weighted loads includes concrete masonry unit blocks and bricks which are readily available around buildings. It should be recognized, however, that many other objects would be suitable as well.

Figure 5:
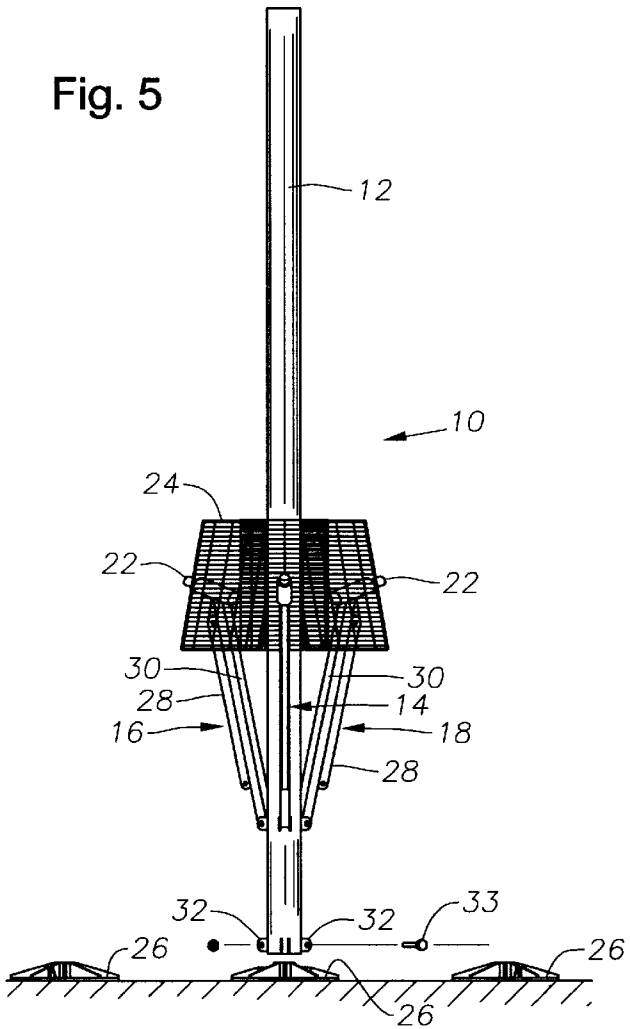
FIG. 5 depicts the antenna mount of FIGS. 1–3 collapsed for transportation or storage.

FIGS. 4 and 5 illustrate collapse of the antenna mount 10 from the fully deployed and operational position shown in FIGS. 1–3. FIG. 4 shows the antenna mount 10 partially collapsed, while FIG. 5 depicts the antenna mount 10 after having been fully collapsed for storage or transport. As can be seen, connectors 33 are removed from the brackets 32 securing each of the three lower struts 28 from the antenna mounting shaft 12. The support legs 22 are unseated from the bases 26, and each of the three leg assemblies 14, 16 and 18 are folded upwardly against the antenna mounting shaft 12 as depicted. With the exception of the three bases 26, the entire antenna mount 10 can be stored or transported as a single unit and can be quickly reassembled and put into operation merely by unfolding the leg assemblies 14, 16 and 18, using three connectors 33 to reconnect the lower struts 28 to the shaft 12, and reseating the three support legs 22 into the bases 26.

Referring now to FIGS. 6–9, an alternative exemplary antenna mount 50 is shown that is useful for mounting multiple antennas. The mount 50 includes two antenna mounting shafts 52, 54, although it should be understood that there might be additional such mounting shafts. The mounting shafts 52, 54 are supported by a frame 56 that includes a pair of vertical poles 58 that are interconnected by two horizontal cross-struts 60. The poles 58 are preferably shorter than the antenna mounting shafts 52, 54. Lateral struts 62, 64 interconnect each of the vertical poles 58 to one of the shafts 52 or 54. It is noted that the lower struts 62 are essentially disposed in a horizontal relation, while the upper struts 64 are angled upwardly from the pole 58 to the shaft 52 or 54. A pair of additional horizontally-disposed cross-struts 66 interconnect the two mounting shafts 52, 54. As a result of this cross-bracing by the struts, the support frame 56 is quite sturdy.

A platform 68 is affixed to and extends horizontally between the two poles 58. The platform 68 is positioned above the support surface 69 upon which the mount 50 would rest and includes three horizontal braces 70 that support a rigid grate 72. The grate 72 is a grid that defines a plurality of apertures through which airflow and drainage is permitted. The braces 70 are arranged in a spaced relation from one another, and the outermost braces are each affixed at one of their ends to one of the poles 58 and at the other end to a vertically-oriented leg 74 (see FIG. 8). The preferred method for affixing the braces to these components is by welding.

Substantially circular, load distribution bases 76 are affixed to the lower ends of the antenna mounting shafts 52, 54 as well as each of the support poles 58 and the legs 74. The bases 76 serve the same purposes, and are preferably of the same type, as the bases 26 described earlier and effectively distribute the weight load of the mount 50 across the support surface 69.

Again, the platform 68 is maintained above the support surface 69 by the support legs 74 and the poles 58. The load forces provided by weights placed on the platform 68 are transmitted through the legs 74, poles 58, and shafts 52, 54 to the bases 76 and are then effectively distributed across the support surface 69 by the bases 76.

For each of the mounts 10, 50 described herein, the components other than the antenna mounting shafts are considered to constitute a frame that anchors the shaft into a substantially vertical orientation. In order to set up the antenna mounts of the present invention and place them into operation, the shaft is affixed to the frame so that it is so anchored. The frame and shaft are then disposed upon a support surface such as a roof surface. No connectors or adhesive are required, although they may be used if desired. Next, the platforms of the mounts are weighted using a load of appropriate weight to stabilize the mount against expected wind forces. The support legs and other vertical members receive the weight load from the platforms and transmit it to the load distributing bases which, in turn, distribute the weight load substantially evenly across portions of the support surface.

A significant advantage of the antenna mounts of the present invention is that they provide stable and wind resistant mounts that are not affixed to the structure of the building upon which they are placed. As a result, the mount is not considered a "live load" for the building, becoming subject to the more stringent load distribution requirements that are frequently associated with live loads for building roofs. The antenna mounts of the present invention also provide the advantage of being portable and easily removed or relocated without first having to remove connectors or deal with adhesives that have been used to secure the mount to the roof.

Additionally, in preferred embodiments, the mounts are transported and delivered as complete units that are collapsed during storage and transport. For use, the units are simply be unfolded and put into place. There is no need to assemble a number of separate components from a kit.

While the invention has been shown or described in only some of its forms, it should be apparent to those skilled in the art that it is not so limited, but is susceptible to various changes within departing from the scope of the invention.

What is claimed is:

1. An antenna mount comprising:

a mounting shaft for affixation of an antenna;

a plurality of support legs operably associated with the shaft for anchoring of the shaft in a substantially vertical orientation, wherein each support leg having a lower end and an upper end;

the lower end of each support leg being affixed to a load-distributing base for placement upon a support surface, the support bases being substantially devoid of sharp corners or angles that might damage the support surface; and the upper end of the support leg receiving a weight load and transmitting the weight load through the support leg to the load distributing bases.

2. The antenna mount of claim 1 wherein said each support base has a substantially circular footprint.

3. The antenna mount of claim 1 wherein the mount is collapsible into a compact unit for storage or transport.

4. The antenna mount of claim 1 wherein there is more than one mounting shaft for affixing an antenna.

5. The antenna mount of claim 4 wherein a load distributing base is affixed to the lower end of each mounting shaft.

6. The antenna mount of claim 1 wherein the upper end of said each support leg for receiving the weight load has an affixed platform for the placement of weights to stabilize the antenna mount.

7. The antenna mount of claim 6 further comprising a strut extending between said each support leg and the antenna mounting shaft.

8. The antenna mount of claim 6 wherein the platform comprises an apertured grate.

9. A frame for supporting an antenna mounting shaft, the frame comprising:

a plurality of support legs that are interconnected with the antenna mounting shaft for support therefor;

a platform associated with the support legs for the placement of weights to stabilize the frame and shaft; and a plurality of load distributing bases within which the legs are disposed, the bases receiving a weight load from the legs and distributing the weight load substantially evenly across a support surface upon which the base is disposed.

10. The frame of claim 9 further comprising a plurality of struts for supporting the antenna mounting shaft.

11. The frame of claim 9 wherein the platform comprises a substantially rigid grate that defines a plurality of apertures through which airflow and drainage is permitted.

12. An antenna mount comprising;

a plurality of mounting shafts for affixation of antennas;

at least one strut interconnecting two of said mounting shafts;

a plurality of support legs operably associated with said shafts for anchoring of the shafts in a substantially vertical orientation, each of the support legs having lower end and an upper end;

the lower end of each support leg being affixed to a load-distributing support base for placement upon a support surface, the support base being substantially devoid of sharp corners or angles that might damage the support surface; and the upper end of each support leg receiving a weight load and transmitting the weight load through the support leg to the support base.

13. The antenna mount of claim 12 wherein the upper end of the support legs are affixed to a platform for the placement of weights to stabilize the antenna mount.

14. The antenna mount of claim 12 wherein the support base has a substantially circular footprint.

15. A method for providing an antenna mount comprising:

providing a frame to which an antenna mounting shaft is to be anchored, the frame comprising:

a plurality of support legs to be operably associated with the shaft for anchoring of the shaft in substantially vertical orientation, the support leg having a lower end and an upper end, the lower end of each of said support legs being affixed to a load-distributing support base for placement upon a support surface, the support bases being substantially devoid of sharp corners or angles that might damage the support surface, and the upper end of the support leg adapted to receive a weight load and transmit the weight load through the support leg to one of the support bases;

anchoring an antenna mounting shaft to the frame in a substantially vertical orientation;

disposing the frame and shaft upon a support surface; and placing weights upon portions of the frame to ensure stability and wind resistance of the frame.

16. The method of claim 15 wherein the operation of placing weights upon portions of the frame comprises disposing weights upon a platform located above the support surface.

* * * * *